US006641493B1

(12) United States Patent
Shifflett

(10) Patent No.: US 6,641,493 B1
(45) Date of Patent: Nov. 4, 2003

(54) METHOD OF FLETCHING ARROWS WITH A REFLECTIVE WRAP

(76) Inventor: Tony J. Shifflett, P.O. Box 30, Dyke, VA (US) 22968

( * ) Notice: Subject to any disclaimer, the term of this patent is extended or adjusted under 35 U.S.C. 154(b) by 0 days.

(21) Appl. No.: 10/080,464

(22) Filed: Feb. 23, 2002

Related U.S. Application Data

(60) Provisional application No. 60/278,478, filed on Mar. 23, 2001.

(51) Int. Cl.[7] ..... F42B 6/04
(52) U.S. Cl. ..... 473/578; 473/586
(58) Field of Search ..... 473/578, 586

(56) References Cited

U.S. PATENT DOCUMENTS 3,595,579 A * 7/1971 Benoit
5,024,448 A * 6/1991 Barrie
5,039,110 A * 8/1991 Honda
5,443,272 A * 8/1995 Vincent

OTHER PUBLICATIONS

Kittredge Bow Hut Archer's Bible, 1958–59, p. 58, "Crest Decal".*
Martin Archery Catalog, 1989, p. 78, "Quick Dip Arrow Wrap".*

* cited by examiner

*Primary Examiner*—John A. Ricci
(74) *Attorney, Agent, or Firm*—Sturm & Fix LLP

(57) ABSTRACT

A method using an existing product (50) to produce improved hunting arrowshafts (20) by wrapping a strip (51) of material (50) having an adhesive coated inner surface (52) and a reflective and/or luminous outer surface 53 around the nock portion (21) of the shaft (20) to form an intermediate layer; and, using a standard fletching technique to anchor vanes or feathers (40) to the reflective/florescent/luminous outer surface (53) of the strip of material (50).

9 Claims, 1 Drawing Sheet

METHOD OF FLETCHING ARROWS WITH A REFLECTIVE WRAP

CROSS REFERENCE TO RELATED APPLICATIONS

This application is based on Provisional Patent Application Ser. No. 60/278,478, filed on Mar. 23, 2001, and entitled "Glo-Wrap-Reflective Archers Arrow Aid."

BACKGROUND OF THE INVENTION

1. Field of the Invention

The present invention relates to the field of archery in general and in particular to a method and apparatus for both facilitating the installation of fletching on all arrows in general and in particular for checking the sizing of individual shafts and producing an improved hunting arrow in the process.

2. Description of Related Art

As most people who are actively involved in the sport of archery are aware, the cresting of arrow shafts with different colored and width painted stripes has long been accepted as the preferred way of identifying one archers arrows from another archers arrows.

While this particular method is more than adequate for the basic purpose and function for which it has been intended, it is uniformly deficient with respect to its failure to provide a simple, efficient, and practical method and apparatus for simplifying the application of fletching on arrows with the added benefit of producing an improved hunting arrow in the process.

Another problem encountered in particular with the new carbon shafts is the inclusion of one or more mislabled shafts in a box of a dozen commercially available carbon arrows; wherein due to the relatively small diameters of the individual shafts, the slight differences in the circumference of the shafts are not readily visible and the only way to determine if all of the arrows are properly sized is to weigh each arrow on a grain scale.

Furthermore, the material that is currently employed as a cresting wrap has a uniform thickness of 2 mm which not only lacks durability under most hunting conditions, but is also far too thin to possess any reflective coating which forms the heart of the present invention.

As a consequence of the foregoing situation, there has existed a longstanding need in the archery community for a new and improved method and apparatus for checking for mis-marked shafts, and providing a reflective surface operatively associated with the fletching. The provision of such a method and apparatus is the stated objective of the present invention.

BRIEF SUMMARY OF THE INVENTION

Briefly stated, the method and apparatus for installing fletching on arrow shafts that forms the basis of the present invention is relatively simple and straightforward in hindsight; however, its simplicity is both ingenious and unobvious in both the results it produces for all types of archers in general and in particular for bow hunters.

As will be explained in greater detail further on in the specification, the heart of this invention revolves around the use of a commercially available product which is specifically designed to be employed in large sheets for external signage and wide strips that are applied to fixed structures and clothing to alert individuals to the presence of obstacles or people in low light or dark conditions. The crux of this invention is to employ this commercially available product in a new manner and fashion to provide decorative "cresting" or marking of the arrow shaft in an identifying manner that is somewhat unique to each individual arrow shaft. The product further possesses luminous and/or florescent properties which facilitate both the retrieval of an arrow in low light conditions or after dark and also gives a bow hunter a truer indication of the trajectory of an arrow shot at a game animal after dark as long as the nock end of the arrow has not penetrated the animal's body cavity.

Given all of the attractive benefits and properties attained through the use of this particular product, it is amazing that to date no one has also discovered the unexpected results produced by using this product as an intermediate layer between a carbon or graphite arrow shaft and fletching; wherein, the intermediate layer has an inner adhesive coating that secures the wrapped layer to the nock end of a carbon arrow and an outer florescent and/or reflective material impregnated surface which readily accepts most common fletching techniques to securely anchor fletching to carbon or graphite arrows. Furthermore, by producing the cresting material in strips having specific dimensions the user can quickly and easily make a determination as to whether or not a particular arrow is properly sized regardless of the alleged size provided by the manufacturer.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
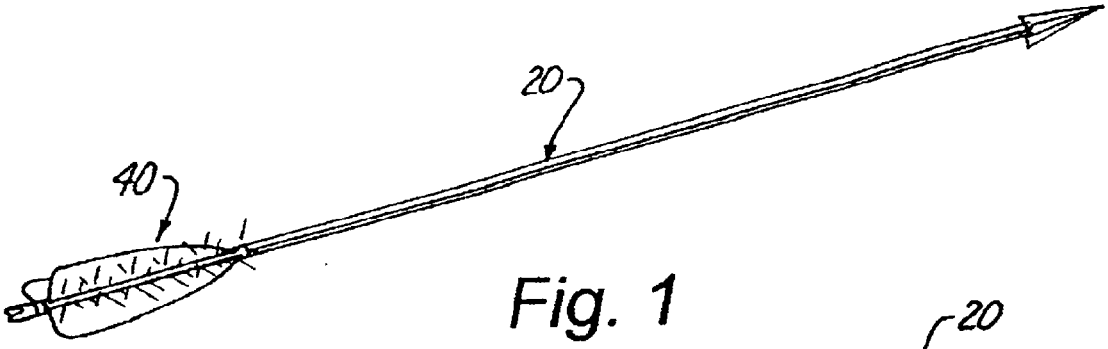
FIG. 1 is a perspective view of an arrow shaft fletched in accordance with the teachings of this invention.

The method that forms the basis of the present invention is sequentially depicted in FIGS. 2 through 5, and the "fletched" arrow shaft produced thereby is shown in FIG. 1.

Prior to embarking on a detailed description of the steps employed in the method of this invention, it would first be advisable to describe the product that forms the intermediate layer (30) that is disposed in an encircling manner around the nock end portion (212) of a carbon or graphite arrow shaft (20) and which forms an anchor surface for conventional plastic or feather arrow fletching designated generally as (40).

The product that forms the crux of this invention is manufactured by Avery Graphics Media North America and is marketed under the trademark GLO-WRAP and comprises a sheet of material (50) having an adhesive coating (52) provided on one side and a reflective/florescent/luminous coating (53) formed on the other side.

As was mentioned previously, the GLO-WRAP material is normally produced in large sheets or rolls of elongated wide strips. In order to function in accordance with the teachings and structure of this invention, those sheets and/or rolls must be further reduced into discrete strips precisely dimensioned to conform to the circumference of carbon arrows of a particular size.

In the preferred embodiment of the invention depicted in FIGS. 2 through 5, it can be seen that the sheet of GLO-WRAP material is cut into an elongated rectangular strip (51) for each carbon or graphite arrow (20) that is to be "fletched" in accordance with the teachings of this invention.

It should further be noted that the length "L" and width "W" of each strip (51) of GLO-WRAP material (50) are specifically chosen such that the value of "L" is greater than the length of each individual plastic vane or feather (40) employed in the fletching process and the value of "W" is almost exactly equal to, but less than, the circumference of the particular arrow shaft (20) for reasons that will be explained presently.

Figure 2:
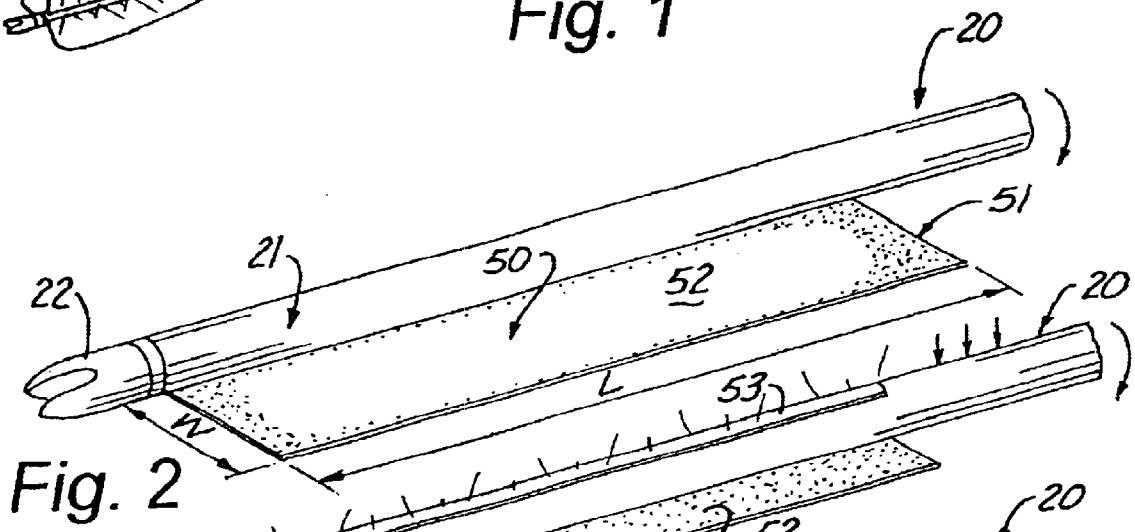
FIG. 2 depicts the first step in the method.
Figure 3:
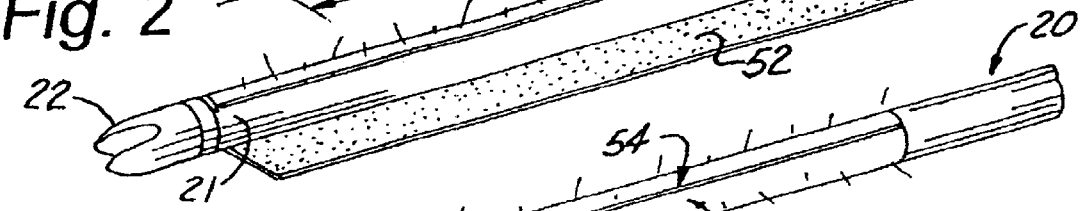
FIG. 3 depicts the application of the intermediate layer to the arrow shaft.

Turning now to FIG. 2, it can be seen that in the first step of the process, a bare arrow shaft equipped with an arrow nock (22) is placed on any suitable flat surface wherein the nock portion (21) of the shaft (20) is placed flush against one of the elongated sides of the GLO-WRAP strip (51) such that the distal end of the strip aligns with, but does not extend beyond, the visible juncture of the nock (22) and the shaft.

Figure 4:
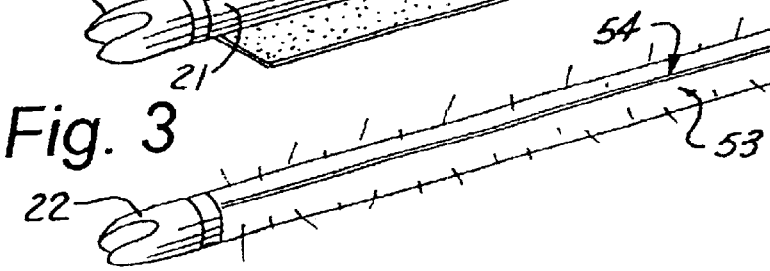
FIG. 4 depicts a finished "wrapped" arrow shaft.

As shown in FIG. 4, due to the sizing of the width "W" of the strip (51) produces a "wrapped" shaft wherein the opposed edges of the strip (51) do not overlap, which would disrupt the aerodynamic flight characteristics of the finished arrow. In addition, since the strips 51 are specifically presized to fit specific circumference arrows, the presence of a noticeable gap or an overlap will give the person applying the strip 51 an immediate visual indication that they are dealing with a mis-sized arrow that should either be discarded or returned to the manufacturer.

Figure 5:
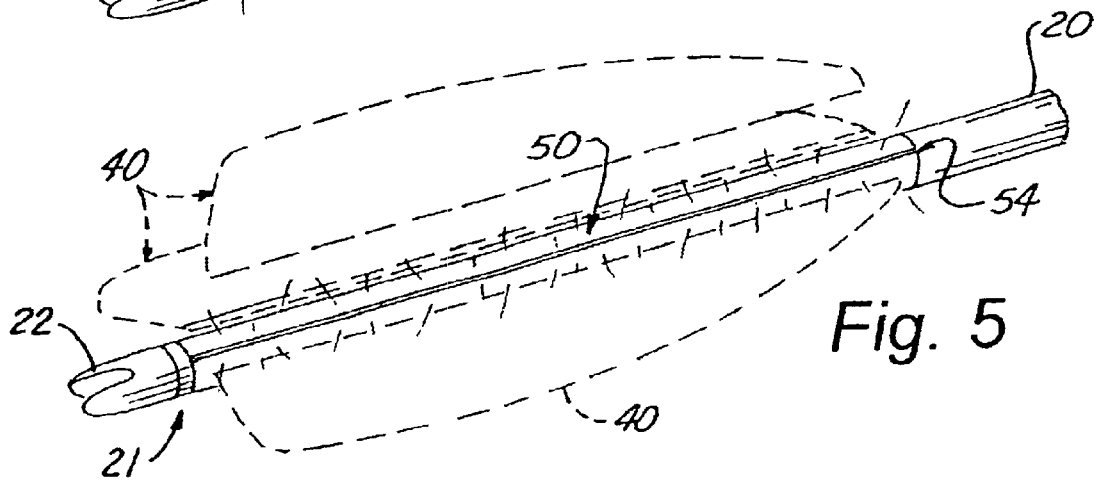
FIG. 5 depicts the fletching being applied to the wrapped nock end of the arrow shaft.

Furthermore, as shown in FIG. 5, the seam (34) may provide a visual reference for radially aligning the fletching (40) around the circumference of the shaft (20) wherein the seam (34) is normally equally offset from adjacent fletchings to enhance the aesthetic appearance of the finished shaft.

Turning now to the final step in the process, shown in FIG. 5, it can be appreciated that once the nock portion (21) of the bare shaft (20) has been properly wrapped, the adhesive surface (52) secures the strip (51) of GLO-WRAP material (50) directly to the exterior surface of the shaft (20). At this juncture, any conventional fletching technique can be employed to securely anchor the base of the feathers or vanes (40) to the exterior reflective/florescent/luminous surface (53) of the GLO-WRAP material (50).

It should further be appreciated that in its simplest form, this invention merely involves adhesively securing a strip of material round the nock portion of an arrow wherein the exterior surface of this intermediate layer is compatible with all types of fletching adhesives in order that fletching may be securely anchored to the exterior surface of the intermediate layer.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A new and improved technique for both sizing the circumference of arrow shafts and for attaching plastic and feather fletching on the nock portion of an arrow shaft made from among the following materials: wood, fiberglass, aluminum, carbon or graphite compositions wherein the method comprises the steps of:

a) wrapping an elongated precisely dimensioned rectangular strip of material having an adhesive coated inner surface and a highly visible outer surface around the nock portion of the arrow shaft with the adhesive surface being in direct contact with the nock portion of the arrow shaft;

b) employing a selected one of a variety of conventional fletching technique to secure the base of the fletching directly to the highly visible outer surface of the strip of material;

c) sizing said strip of material such that the length of said strip is greater than the length of the base of the fletching: and, d) sizing said strip of material such that the width of said strip of material coincides with an arrow shaft having a specific circumference for the purpose of identifying arrow shafts having circumferences larger and smaller than said specific circumference.

2. The method as in claim 1; wherein, the highly visible top surface of the sheet of material possesses at least one of the following characteristics: reflectively, florescence, and luminosity.

3. The method as in claim 1; wherein, the highly visible top surface of the sheet of material possesses at least two of the following characteristics: reflectively, florescence, and luminosity.

4. The method as in claim 1; wherein, the highly visible top surface of the sheet of material possesses all of the following characteristics: reflectively, florescence, and luminosity.

5. A method of both sizing the circumference of arrow shafts and fletching arrow shafts having a specific circumference comprising the steps of:

a) choosing a sheet of material having a bottom surface having an adhesive surface capable of adhering to carbon and/or graphite composite surfaces and a highly visible top surface; wherein, the top surface is compatible with all types of conventional fletching adhesives b) removing a previously dimensioned elongated rectangular strip from said sheet of material; wherein, the length of said strip is greater than the length of a desired fletching and wherein, the width of said strip of material coincides with an arrow shaft having a specific circumference.

c) aligning the longitudinal axis of the strip of material with the longitudinal axis of one end of the arrow shaft;

d) wrapping the strip of material around the circumference of the arrow shaft; and, e) using a selected conventional fletching technique to adhere the fletching to said highly visible top surface.

6. The method as in claim 5 further comprising the following intermediate step:

f) sizing said strip of material such that the length of said strip is greater than the length of the base of the fletching.

7. The method as in claim 5 further comprising the following intermediate step:

g) sizing said step of material such that the width of said strip of material is approximately equal to but less than the circumference of said shaft.

8. The method as in claim 3 wherein, the highly visible top surface of the sheet of material possesses at least two of the following characteristics; reflectively, floresence, and luminosity.

9. The method as in claim 5 wherein, the highly visible top surface of the sheet of material possesses all of the following characteristics; reflectively, floresence, and luminosity.

* * * * *